US006276610B1

(12) United States Patent
Spoolstra

(10) Patent No.: US 6,276,610 B1
(45) Date of Patent: Aug. 21, 2001

(54) CONTROL VALVE

(75) Inventor: Gregg R. Spoolstra, Byron Center, MI (US)

(73) Assignee: Diesel Technology Company, Kentwood, MI (US)

( * ) Notice: Subject to any disclaimer, the term of this patent is extended or adjusted under 35 U.S.C. 154(b) by 0 days.

(21) Appl. No.: 09/209,725

(22) Filed: Dec. 11, 1998

(51) Int. Cl.[7] ..... F02D 1/06

(52) U.S. Cl. ..... 239/5; 239/88; 239/91; 417/505

(58) Field of Search ..... 239/5, 88, 89, 239/91, 93, 95; 417/297, 505, 506; 123/496, 458, 506

(56) References Cited

U.S. PATENT DOCUMENTS

| | | | | |
|---|---|---|---|---|
| 4,445,484 | * | 5/1984 | Marion | 417/506 |
| 4,784,101 | | 11/1988 | Iwanaga et al. . | |
| 5,605,289 | | 2/1997 | Maley et al. . | |
| 5,651,345 | | 7/1997 | Miller et al. . | |
| 5,738,075 | * | 4/1998 | Chen et al. | 123/446 |
| 5,884,848 | | 3/1999 | Crofts et al. . | |
| 5,887,790 | | 3/1999 | Flinn . | |
| 5,894,992 | | 4/1999 | Liu et al. . | |
| 5,954,487 | * | 9/1999 | Straub et al. | 417/505 |
| 5,976,413 | | 11/1999 | Diaz et al. . | |
| 6,012,644 | | 1/2000 | Sturman et al. . | |
| 6,019,091 | | 2/2000 | Spoolstra . | |
| 6,019,344 | | 2/2000 | Engel et al. . | |
| 6,053,421 | | 4/2000 | Chockley . | |
| 6,059,545 | | 5/2000 | Straub et al. . | |

FOREIGN PATENT DOCUMENTS

| | | |
|---|---|---|
| 0 803 648 A1 | 4/1997 | (EP) . |
| 0 823 529 A2 | 8/1997 | (EP) . |

OTHER PUBLICATIONS

D. R. Coldren and M. E. Moncelle; Advanced Technology Fuel System For Heavy Duty Diesel Engines; SAE Technical Paper Series, 973182.

* cited by examiner

*Primary Examiner*—Andres Kashnikow
*Assistant Examiner*—Christopher S. Kim
(74) *Attorney, Agent, or Firm*—Brooks & Kushman P.C.

(57) ABSTRACT

Pumps and injectors having a control valve spring arrangement configured to provide a force step when the control valve is at a rate shape position, and related methods for operating a control valve, are provided. The control valve is moveable over a stroke range between an open position and a closed position. The stroke range includes a rate shape position. The control valve spring arrangement is configured to provide a first spring force when the control valve is between the closed position and the rate shape position, and to provide a second spring force that is less than the first spring force when the control valve is between the rate shape position and the open position.

24 Claims, 11 Drawing Sheets

Fig. 8
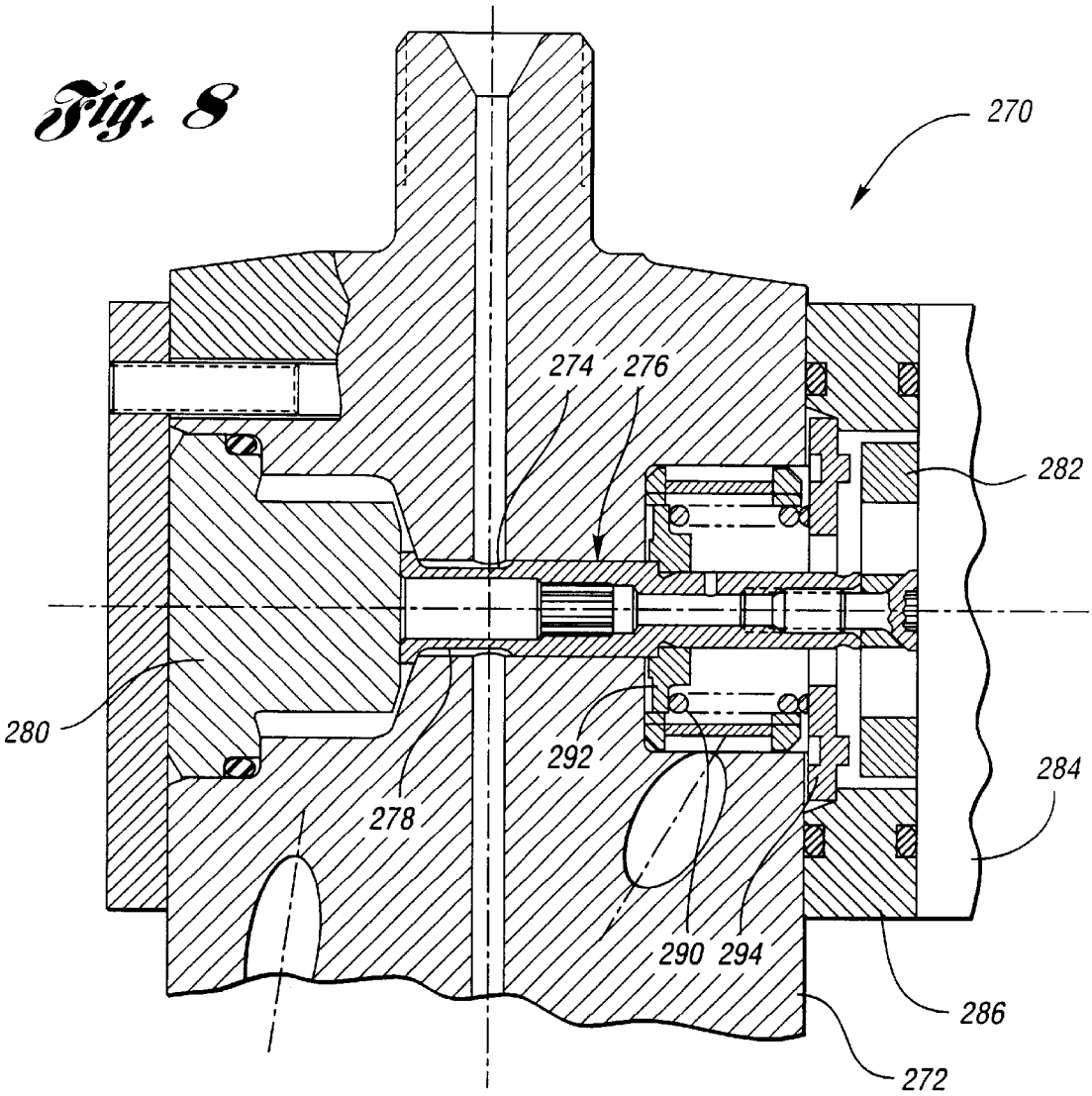
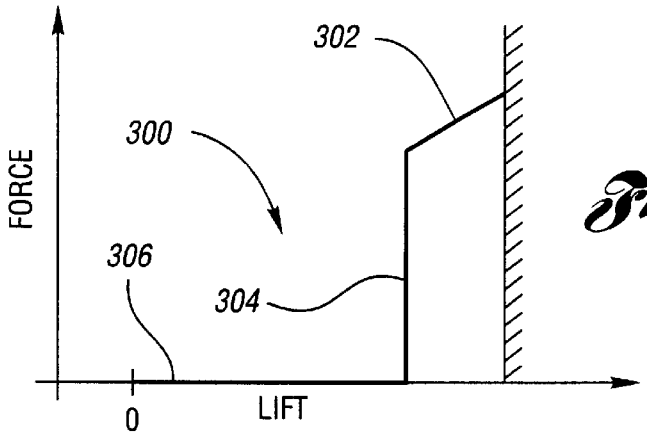
Fig. 9

CONTROL VALVE

TECHNICAL FIELD

This invention relates to a control valve for use in a diesel fuel injection system.

BACKGROUND ART

Engine exhaust emission regulations are becoming increasingly restrictive. One way to meet emission standards is to rate shape the quantity and timing of the fuel injected into the combustion chamber to match the engine cycle. Effective rate shaping may result in reduced levels of particulate and oxides of nitrogen in the engine exhaust. Further, effective rate shaping that injects fuel slower during the early phase of the combustion process results in less engine noise.

Existing rate shaping techniques attempt to control injection rates by making various modifications to the injector nozzle assembly. Although these existing rate shaping techniques have been employed in many applications that have been commercially successful, there is a need for a rate shaping technique that allows more precise rate shaping than the existing modified injector nozzle assemblies.

DISCLOSURE OF INVENTION

It is, therefore, an object of the present invention to provide pumps and injectors having a control valve capable of shaping the injection rate.

It is another object of the present invention to provide a method for operating a control valve with a stepped spring force for rate shaping.

In carrying out at least one of the above objects, a pump for a fuel injection system is provided. The pump comprises a pump body having a pumping chamber, a fuel inlet for supplying fuel to the pumping chamber, an outlet port, and a control valve chamber between the pumping chamber and the outlet port. The pump further comprises a plunger disposed in the pumping chamber, and an actuatable control valve disposed in the control valve chamber for controlling fuel. The control valve is moveable over a stroke between an open position and a closed position. The stroke range includes a rate shape position between the open position and the closed position.

A valve stop is adjacent to the control valve chamber. A control valve spring arrangement biases the control valve toward the open position. An armature is located at the control valve. A stator near the armature includes an actuator operable to urge the control toward the closed position against the bias of the control valve spring arrangement.

The control valve spring arrangement is configured to provide a first spring force when the control valve is between the closed position and the rate shape position. Further, the control valve spring arrangement is configured to provide a second spring force, which is less than the first spring force, when the control valve is between the rate shape position and the open position. Further, a stroke portion from the closed position to the rate shape position is sufficiently small such that controlled injection rate shaping is provided when the control valve is at the rate shape position.

In a preferred embodiment, the stroke portion between the closed position and the rate shape position is at most about 0.03 millimeters. Further, in a preferred embodiment, the stroke range is at least about 0.1 millimeters, or approximately three times the rate shape stroke portion.

In one embodiment, the control valve spring arrangement comprises a primary spring and a secondary spring. The primary spring biases the control valve toward the open position over a limited portion of the stroke range between the closed position and the rate shape position. The secondary spring biases the control valve toward the open position throughout the stroke range. The secondary spring cooperates with the primary spring to produce the first spring force. The secondary spring acts unassisted to produce the second spring force.

In another embodiment, the primary spring biases the control valve toward the open position throughout the stroke range; and, the secondary spring biases the control valve toward the closed position over a limited portion of the stroke range between the rate shape position and the open position. Accordingly, the primary spring acts unassisted to produce the first spring force, while the primary spring opposes the secondary spring to produce the second spring force. The secondary spring may be located within a main body of the valve stop and bias a stop member of the valve stop toward the control valve such that the control valve contacts the stop member when the control valve is between the rate shape position and the open position. Preferably, the stop member has an abutment surface for contacting the control valve; and a vent orifice extends from the abutment surface through the stop member to allow fluid flow therethrough.

In yet another embodiment, a single spring biases the control valve toward the open position over a limited portion of the stroke range between the closed position and the rate shape position. The single spring produces the first spring force, and the second spring force is substantially equal to zero.

Further, in carrying out at least one of the above objects, a fuel injector is provided. The fuel injector comprises an injector body having a pumping chamber and a control valve chamber, a plunger disposed in the pumping chamber, and an actuatable control valve disposed in the control valve chamber for controlling fuel. The control valve is moveable over a stroke range between an open position and a closed position. The stroke range includes a rate shape position between the open position and the closed position. A valve stop is adjacent to the control valve chamber. A control valve spring arrangement biases the control valve toward the open position. An armature is at the control valve. A stator near the armature includes an actuator operable to urge the control valve toward the closed position against the bias of the control valve spring arrangement.

The control valve spring arrangement is configured to provide a first spring force when the control valve is between the closed position and the rate shape position. Further, the control valve spring arrangement is configured to provide a second spring force that is less than the first spring force when the control valve is between the rate shape position and the open position. A stroke portion between the closed position and the rate shape position is sufficiently small such that controlled injection rate shaping is provided when the control valve is at the rate shape position.

Both pumps and injectors of the present invention are preferably of the outwardly opening type in which the control valve contacts the valve stop when the control valve is in the open position.

Still further, in carrying out at least one of the above objects, a method for operating a control valve with a variable spring force for rate shaping is provided. The method comprises fully closing the control valve to allow initial injection pressure to build up in the pumping chamber. The control valve is fully closed by supplying a first current to the actuator to cause the control valve to overcome a first spring force in the opening direction. The method further comprises partially opening the control valve to a rate shape position by supplying a second current to the actuator. The second current is less than the first current and causes the control valve to overcome a second spring force. The second spring force is less than the first spring force. Thereafter, the control valve is fully closed to allow main injection pressure to build up in the pumping chamber. At the end of injection, the control valve is fully opened.

The advantages associated with embodiments of the present invention are numerous. For example, control valves made in accordance with the present invention for pumps or injectors allow effective rate shaping by controlling the pressure supplied to the pump outlet or injector nozzle assembly of a unit injector. Rate shaping at the control valve advantageously allows more precise rate shaping than some existing rate shaping techniques that attempt to rate shape with a modified injector nozzle assembly. Injection pressure control is used instead of throttling at the nozzle for injection rate shaping.

The above objects and other objects, features, and advantages of the present invention will be readily appreciated by one of ordinary skill in the art from the following detailed description of the best mode for carrying out the invention when taken in connection with the accompany drawings.

BRIEF DESCRIPTION OF THE DRAWINGS

FIG. 8 is an enlarged cross-sectional view of another alternative control valve environment, that uses a single spring;

FIG. 9 is a graph depicting force versus valve lift for the single spring embodiment shown in FIG. 8;

BEST MODE FOR CARRYING OUT THE INVENTION

Figure 1:
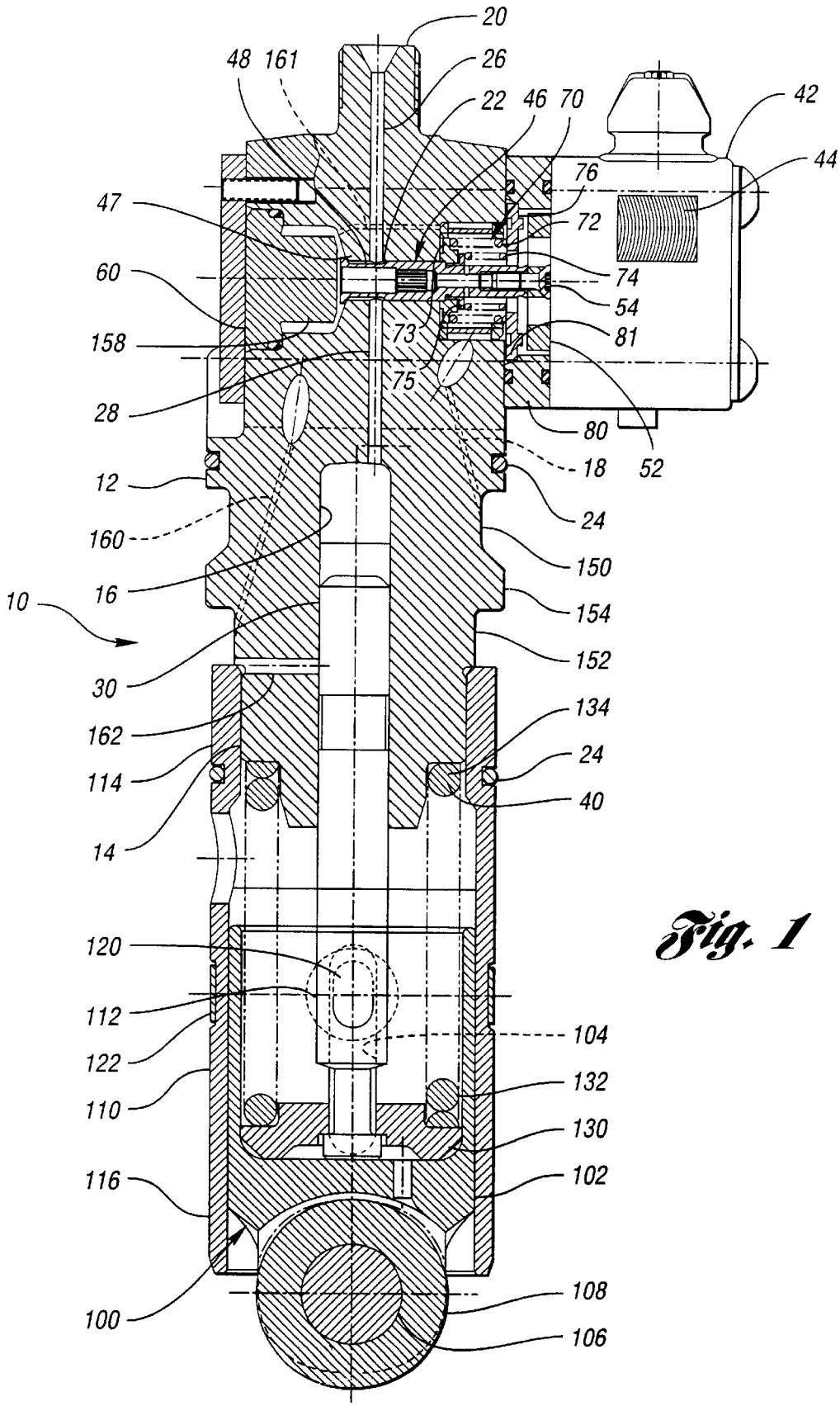
FIG. 1 is a side elevation, in section, of a pump for a fuel injection system made in accordance with the present invention.
Figure 2:
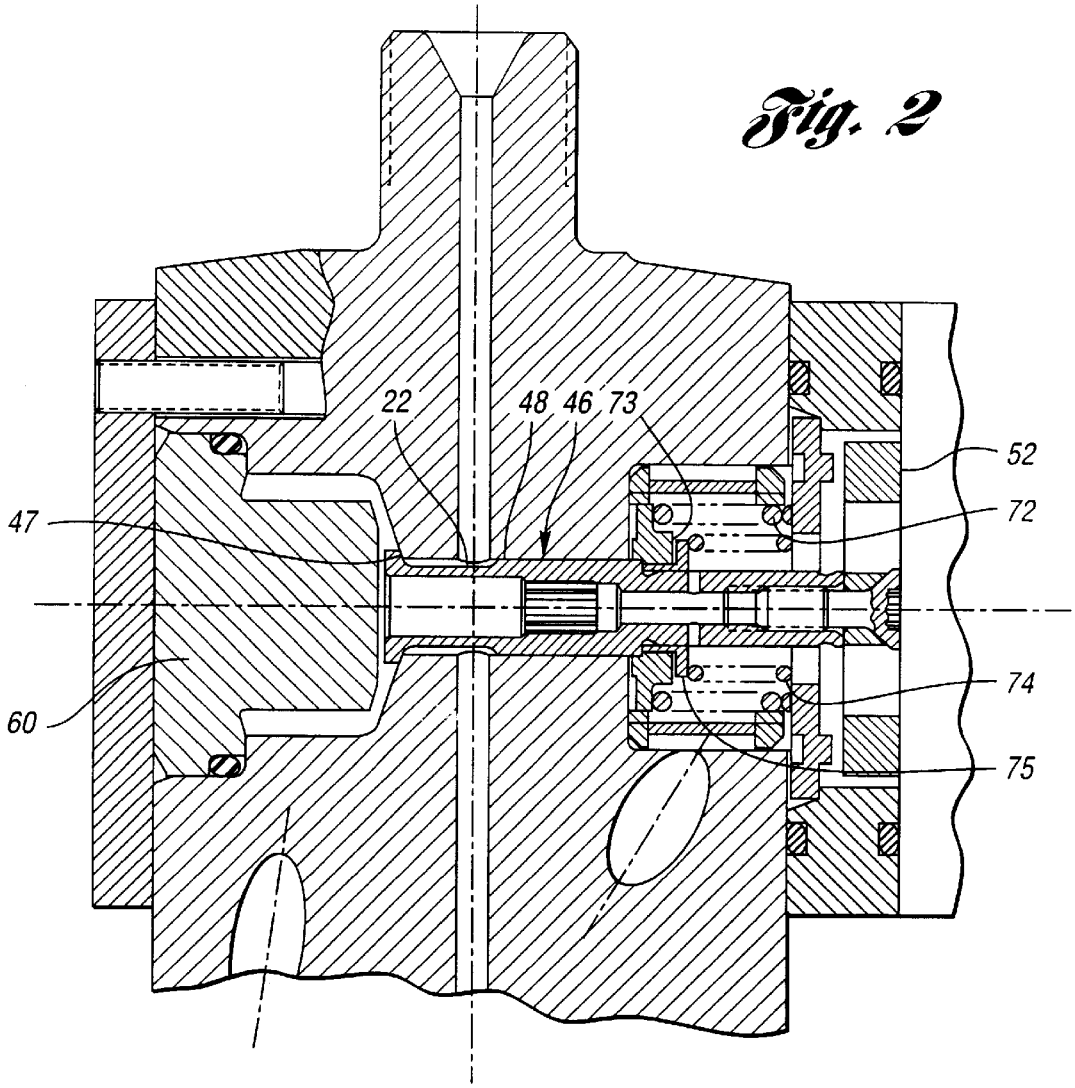
FIG. 2 is an enlarged cross-sectional view of the control valve environment on the pump shown in FIG. 1.

Referring to FIGS. 1 and 2, a pump 10 made in accordance with the present invention is illustrated. Pump 10 has a pump body 12 with a pump body end portion 14. A pumping chamber 16 is defined by pump body 12. A fuel inlet 18 supplies fuel to pumping chamber 16 (through passage 161, stop cavity 158, past control valve seat 47, control valve annulus 22 and passageway 28). Pump body 12 further has an outlet port 20, and a control valve chamber 22 between pumping chamber 16 and outlet port 20. O-rings 24 are provided to seal fuel inlet 18 with respect to an engine block which receives pump 10. Passageways 26 and 28 connect outlet port 20, control valve chamber 22, and pumping chamber 16.

A reciprocating plunger 30 is disposed in pumping chamber 16. Plung 30 is reciprocatable over a stroke range between an extended position indicated at 30 and a compressed position (not specifically shown). A plunger spring 40 resiliently biases plunger 30 to the extended position.

A stator assembly 42 is an electromagnetic actuator such as a solenoid 44, and has terminals for connecting to a power source to provide power for electromagnetic actuator 44. An electromagnetically actuated control valve 46 is disposed in control valve chamber 22 for controlling fuel. Control valve 46 includes a valve body 48. Valve body 48 is movable over an adjustable stroke range between an open position and a closed position as will be further described. The closed position is the actuated position for valve body 48 where the valve is pulled to the control valve seat, and the open position is the deactuated position for valve body 48.

An armature 52 is secured to control valve 46 by a fastener such as a screw 54. A valve stop 60 is disposed in pump body 12 adjacent to control valve chamber 22. A control valve spring arrangement 70 resiliently biases valve body 48 toward the deactuated position, which is the open position. A stator spacer 80 has a central opening receiving armature 52 therein, and is disposed between pump body 12 and stator assembly 42. Stator spacer 80 has notches 81 for receiving retainer 76. O-rings seal stator spacer 80 against stator assembly 42 and pump body 12. Electromagnetic actuator 44 is near armature 52, and upon actuator, urges control valve 46 toward the closed position against the bias of control valve spring arrangement 70 when current is applied to the stator, producing a magnetic field that attracts the armature to the stator.

With continuing reference to FIG. 1, a cam follower assembly 100 is illustrated. Cam follower assembly 100 has a housing 102 with an elongated slot 104. Cam follower assembly 100 has an axle 106 and a roller 108 for engagement with a camshaft (not shown). Plunger 30 is reciprocated within pumping chamber 16 between the extended and compressed positions by cam follower assembly 100. A cylindrical sleeve 110 has an aperture 112 in communication with elongated slot 104. Cylindrical sleeve 110 has first and second end portions 114 and 116, respectively. Pump body end portion 14 interfits with first end portion 114 of cylindrical sleeve 110.

Second end portion 116 of cylindrical sleeve 110 relatively reciprocatably interfits with cam follower assembly 100 for allowing cam follower assembly 100 to drive plunger 30. Cam follower assembly 100 reciprocates within cylindrical sleeve 110 and drives plunger 30 relative to cylindrical sleeve 110 over the plunger stroke range. Preferably, a retainer guide 120 extends through aperture 112 and engages slot 104 in cam follower assembly 100. A clip 122 retains guide 120 within aperture 112.

A plunger spring seat 130 is received in housing 102 of cam follower assembly 100. Plunger spring seat 130 abuts a first end 132 of plunger spring 40. Pump body end portion 14 abuts a second end 134 of plunger spring 40.

Pump body 12 has a first annulus 150 in communication with fuel inlet 18 for supplying fuel to the pumping chamber 16. Pump body 12 further has a second annulus 152 in communication with pumping chamber 16 for receiving excess fuel therefrom. An annular belt 154 separates first and second annuli 150 and 152, respectively.

An excess fuel chamber 158 also called the stop cavity, receives excess fuel from control valve chamber 22 when the control valve 46 is open past control valve seat 47. A fuel equalizing passage 161 provides fuel communication between excess fuel chamber 158 and the control valve and spring chambers such that control valve 46 is operable as a pressure balanced valve. A return passageway 160 connects excess fuel chamber 158 to second annulus 152. Another return passageway 162 connects pumping chamber 16 to second annulus 152 for receiving any fuel that leaks between plunger 30 and pump body 12. Second annulus 152 is defined by annular belt 154 and first end portion 114 of cylindrical sleeve 110. As well known in the art, fuel is supplied to pump 10 through internal fuel passageways in the engine block (not shown).

With reference again to FIGS. 1 and 2, and as best shown in FIG. 2, valve stop 60 is adjacent to control valve chamber 22. As illustrated in the embodiment of the present invention shown in FIGS. 1 and 2, control valve spring arrangement 70 includes a primary spring 72 and a secondary spring 74. Primary spring 72 biases valve body 48 of control valve 46 toward the open position over a limited portion of the stroke range. The portion of the stroke range over which primary spring 72 biases valve body 48 is between the closed position and a rate shape position. A suitable value for the stroke portion between the closed position and the rate shape position is at most about 0.03 millimeters. However, other values may also be suitable depending on the particular application for the pump or injector.

Secondary spring 74 biases valve body 48 of control valve 46 toward the open position throughout the stroke range. Control valve spring arrangement 70, which includes primary spring 72 and secondary spring 74, is configured to provide a first spring force when valve body 48 of control valve 46 is between the closed position and the rate shape position. Further, control valve spring arrangement 70 is configured to provide a second spring force, which is less than the first spring force, when valve body 48 of control valve 46 is between the rate shape position and the open position. As mentioned above, the stroke portion between the closed position and the rate shape position is sufficiently small such that controlled injection rate shaping is provided when the control valve is at the rate shape position.

In the embodiment depicted in FIGS. 1 and 2, secondary spring 74 cooperates with primary spring 72 to produce the first spring force; and, secondary spring 74 acts unassisted to produce the second spring force.

One end of primary spring 72 engages retainer 76, while the other end of primary spring 72 engages a spring seat 73. Spring seat 73 is shaped such that primary spring 72 only biases valve body 48 of control valve 46 over a limited portion of the stroke range. Spring seat 73 abuts pump body 12 when control valve 46 reaches the rate shape position. Secondary spring 74 has one end abutting retainer 76 and another end abutting spring seat 75. Spring seat 75 is configured such that secondary spring 74 biases valve body 48 of control valve 46 toward the open position throughout the stroke range. As depicted, spring seat 73 of primary spring 72 abuts pump body 12 when control valve 46 reaches the rate shape position, while spring seat 75 may further urge valve body 48 of control valve 46 until control valve 46 reaches the fully open position against valve stop 60.

It is to be appreciated that although spring seat 75 is shown having a substantially L-shaped cross-section wherein the longer leg of the L-shape slides through an inner diameter of spring seat 73 to push valve body 48 of control valve 46 to the fully open position against valve stop 60, other configurations for spring seats 73 and 75 are contemplated. Further, spring arrangement 70 may be formed in many configurations in accordance with the present invention, and the embodiment depicted in FIGS. 1 and 2 is merely one example thereof.

Figure 3:
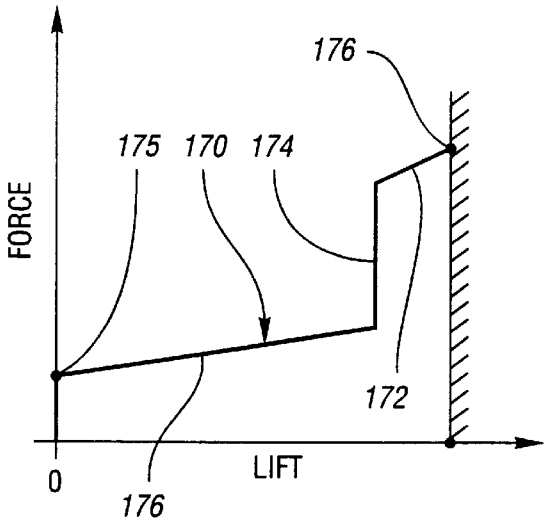
FIG. 3 is a graph depicting force versus valve lift for the control valve shown in FIGS. 1 and 2.

With reference to FIG. 3, a graph depicts force versus valve lift for the control valve arrangement shown in FIGS. 1 and 2. The spring force exerted by control valve spring arrangement 70 (FIGS. 1 and 2) is generally indicated at plot 170. The first spring force which is exerted when the control valve is between the closed position and the rate shape position is indicated at segment 172. The second spring force which is exerted when the control valve is between the rate shape position and the open position is shown at line segment 176. Line segment 174 illustrates a force step at the rate shape position for the control valve. The fully open position for the control valve is indicated at point 175, while the fully closed position is indicated at point 176.

In rate shaping, the control valve is manipulated via solenoid force to hold the valve at positions other than fully opened or closed. These intermediate positions may be used to "bleed off" part of the plunger displacement. The partially open control valve may be utilized to enhance injection in a variety of different ways. For example, the partially open control valve may be utilized to reduce initial injection pressure at the beginning of the injection event, reducing the amounts of fuel injected during the ignition delay portion of the combustion cycle. The reduced ignition pressure facilitates a "boot" injection, which is believed to reduce engine noise.

Further, the partially open control valve may be utilized to limit the spill rate at the end of injection to reduce noise induced by the sudden unloading of the fuel system drive. By limiting the spill rate at the end of injection, the occurrence of cavitation in injection lines and nozzles may be reduced. Further, the partially open control valve may be utilized to minimize the time between a small pilot injection and a main injection of fuel. Split injection reduces combustion noise. With the partially open control valve, the control valve does not have to move as far in between pilot and main injections because it is stopped at a stable intermediate position.

Attempts to hold the control valve at a partially open position simply by reducing solenoid current and therefore hold force, have not provided the desired stability. More particularly, the solenoid force is a function of the square of the distance between the control valve armature and the stator. As such, the resultant force versus distance curve is very steep, making modulation of valve position using only solenoid current difficult.

In accordance with the present invention, a force step is defined by a control valve arrangement to provide a stable partially open position to achieve, among things, some of the advantages described above.

With reference again to FIGS. 1–3, the force step occurs when spring seat 73 seats against pump body 12.

Figure 4:
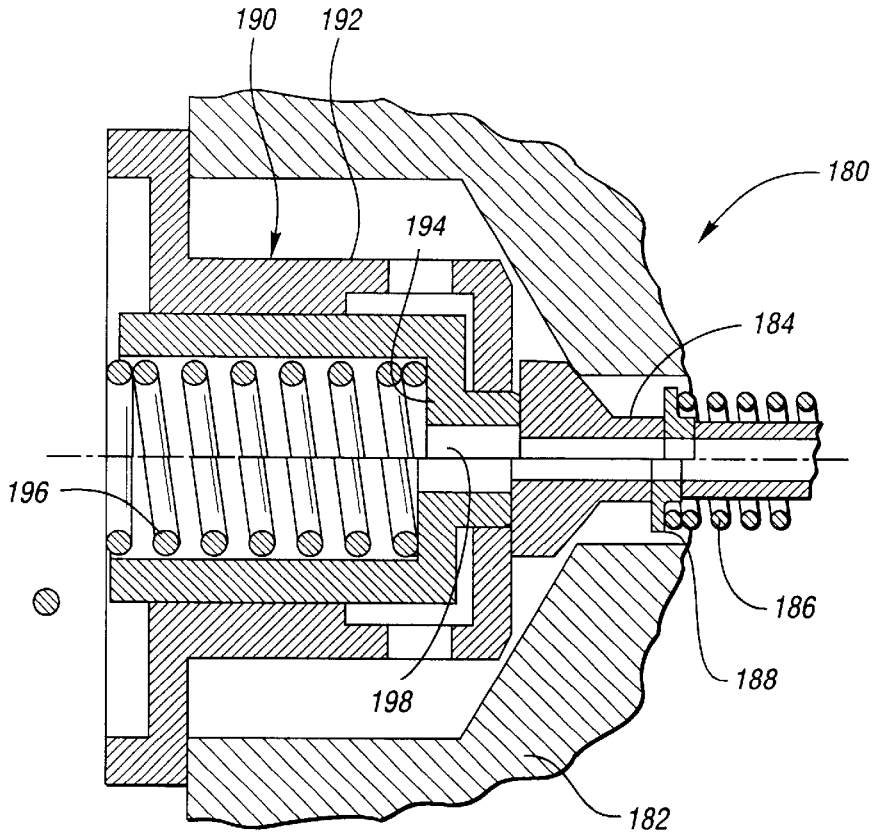
FIG. 4 is an enlarged cross-sectional view of an alternative control valve environment for the pump shown in FIG. 1.

With reference to FIG. 4, an alternative control valve configuration is generally indicated at 180, and is surrounded by pump body 182. A control valve 184 is biased toward its open position throughout the stroke range by a primary spring 186. The control valve is shown in a split view, with the top part of the drawing showing the valve in the rate shaping position and the bottom part of the drawing showing the fully open position. It is appreciated that, as described consistently throughout this specification, the rate shape position for the control valve is at the spring force step point, and the full open position is against the valve stop. The rate shape and full open positions for the other embodiments are also located at the spring force step point and valve stop, respectively, as described herein. Primary spring 186 engages seat 188. A valve stop assembly 190 includes a main body 192 and a stop member 194. Stop member 194 is axially moveable within main body 192. A secondary spring 196 is located within main body 192 and biases stop member 194 toward control valve 184. The control valve spring arrangement, which includes primary spring 186 and secondary spring 196, is arranged such that control valve 184 contacts stop member 194 when control valve 184 is between the rate shape position and the open position. The open position for control valve 184 is when control valve 184 abuts main body 192 of valve stop assembly 190. Primary spring 186 acts unassisted to produce the first spring force when control valve 184 is between the closed position and the rate shape position. Primary spring 186 opposes secondary spring 196 to produce the second spring force when control valve 184 is between the rate shape position and the open position.

A vent orifice 198 in stop member 194 provides fluid damping in addition to spring damping as the control valve moves toward the open position. That is, vent orifice 198 extends from the abutment surface of the stop member through the stop member to allow fluid flow therethrough. The stop member damps the opening of the valve by correct siting of one or more vent orifices to reduce and potentially eliminate undesirable bounce at valve opening. It is to be appreciated that a vented stop member is very advantageous in that in addition to providing a stepping in the spring force to facilitate rate shaping, bounce at valve opening may also be reduced.

Figure 5:
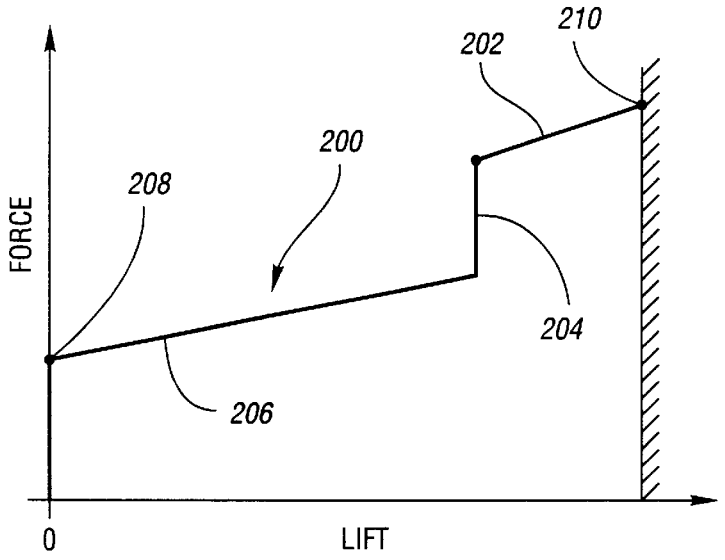
FIG. 5 is a graph depicting force versus valve lift for the alternative control valve environment shown in FIG. 4.

With reference to FIG. 5, a graph depicts force versus valve lift for the control valve spring arrangement shown in FIG. 4. The force plot is generally indicated at 200. The first spring force is indicated at line segment 202. The first spring force line segment 202 is due to unassisted primary spring 186 (FIG. 4). Line segment 204 is the force step that occurs at the rate shape position for the control valve in accordance with the present invention. Line segment 206 depicts the second spring force that is produced by the cooperating primary spring 186 and secondary spring 196 (FIG. 4). The fully open position for the control valve is indicated at point 208, while the fully closed position for the control valve is indicated at point 210. As mentioned above, rate shaping preferably occurs near line segment 204.

Figure 6:
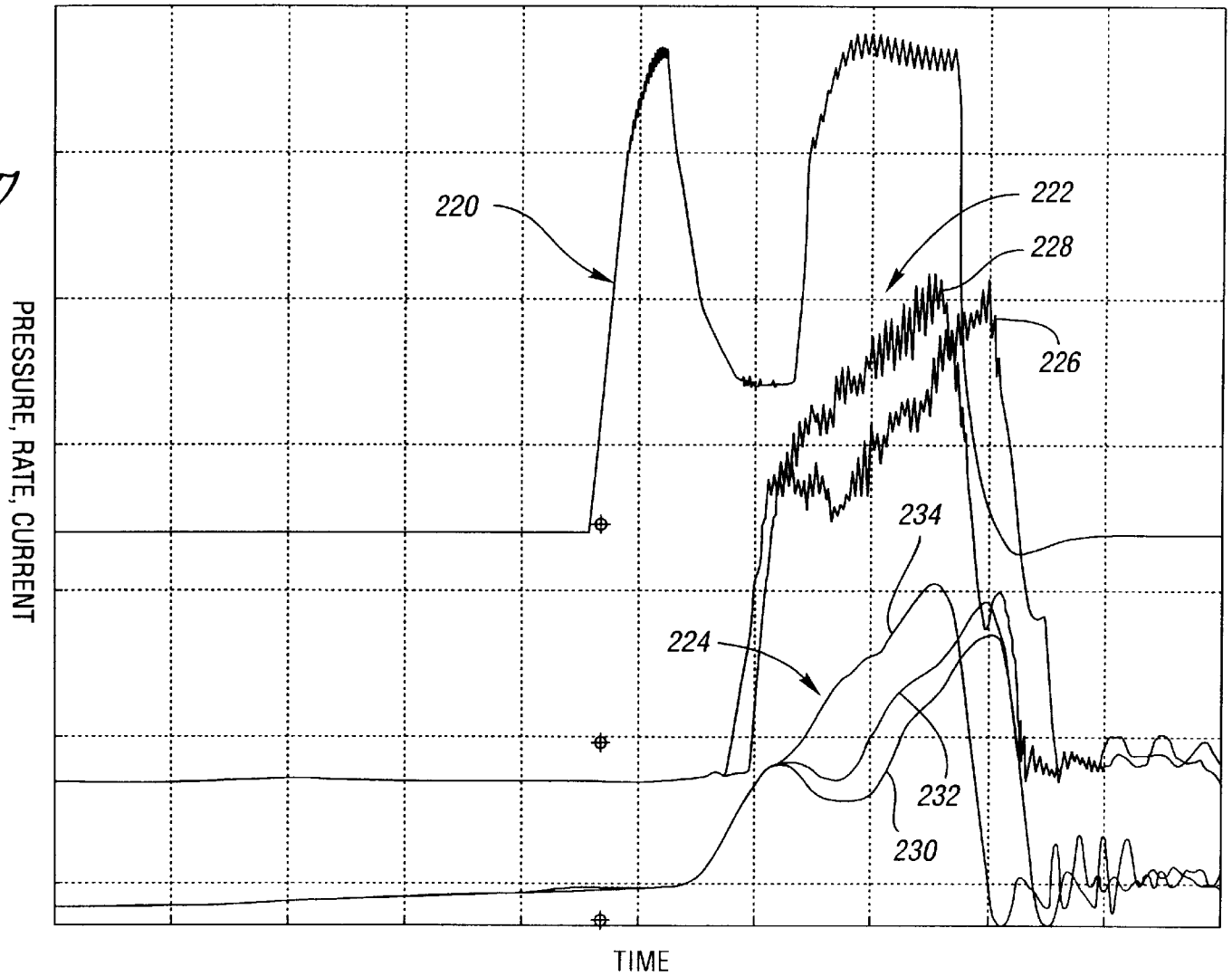
Fig. 6 (PRIOR ART)
FIG. 6 is a graph illustrating injection variations found in the prior art, showing injection pressure, rate, and the actuation current versus time.

In order to truly appreciate the advantages associated with embodiments of the present invention, graphs illustrating prior art fuel injection without the force step of the present invention are shown in FIG. 6. FIG. 6 depicts injection pressure, injection rate, and solenoid current for the actuator versus time during injection. Three different injections are plotted on a time scale to show the shot to shot variation that occurs without the use of stepped spring force. Of course, it is to be appreciated that many existing applications have been commercially successful and have been acceptable for their particular applications. However, the stepped spring force embodiments of the present invention allow even more precise control over the injection process, as would be appreciated by one of ordinary skill in the art of fuel injection systems.

Solenoid current does not vary much from injection to injection, and is generally indicated at 220. Injection rate, which may significantly vary from shot to shot, has several traces generally indicated at 222. Injection pressure, which may also significantly vary from shot to shot, has several traces generally indicated at 224.

First and second injection rate traces 226 and 228, respectively, illustrate quantity variation from shot to shot. First, second and third injection pressure traces 230, 232, and 234, respectively, illustrate shot to shot injection pressure variations.

Figure 7:
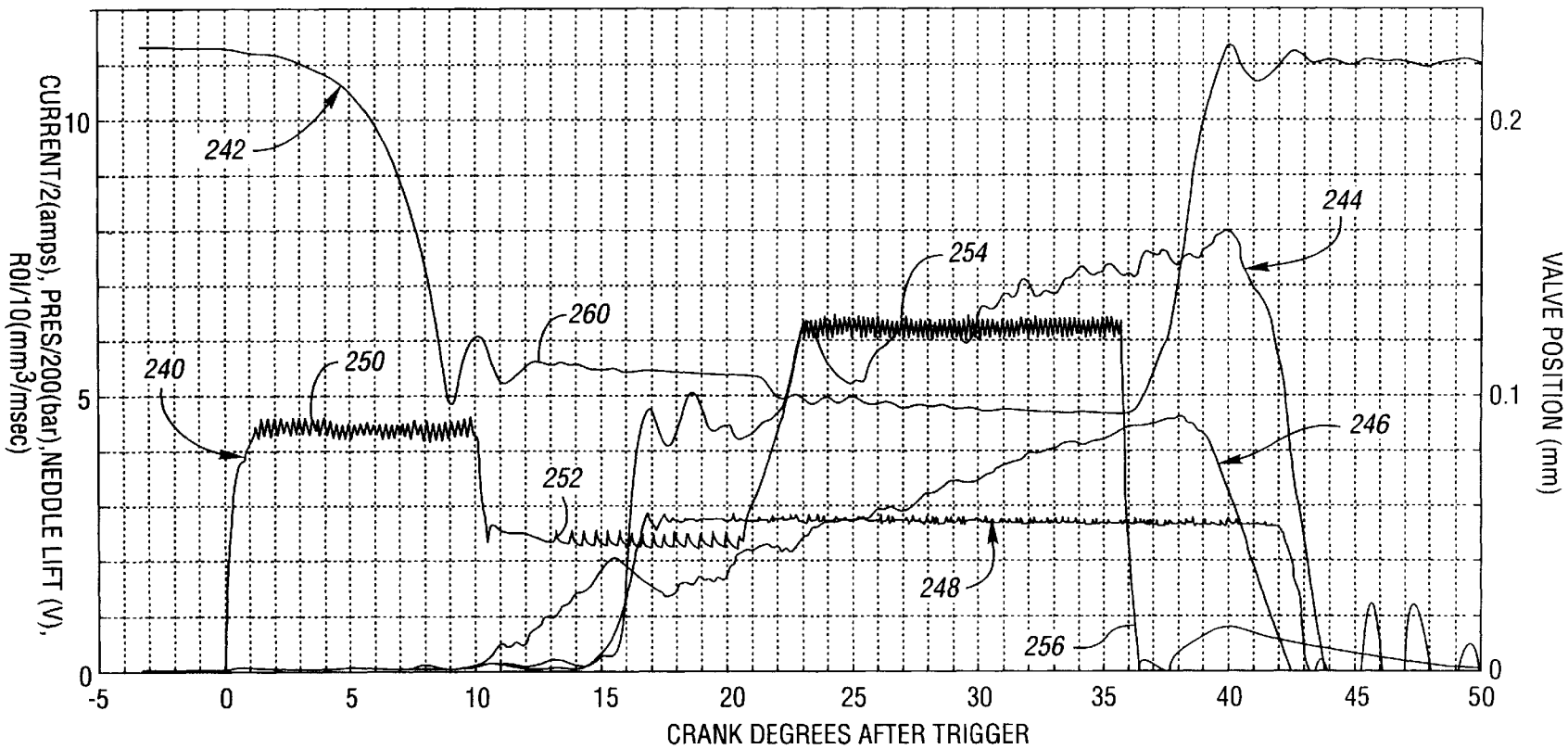
FIG. 7 is a graph depicting fuel injection characteristics in a single boot type injection with the control valve environment shown in FIG. 4.

As can now be better appreciated, FIG. 7 depicts the fuel injection process performed in accordance with the present invention, utilizing the embodiments for a control valve depicted in FIG. 4. Of course, it is to be appreciated that embodiments of the present invention illustrated in FIGS. 1 and 2 are believed to be capable of producing similar results.

With reference to FIG. 7, a graph depicts a plurality of injection characteristics versus crank degrees after trigger. Solenoid drive current is generally indicated at 240, while valve position is generally indicated at 242. Injection pressure is generally indicated at 244, while rate of injection is generally indicated at 246. Needle lift is generally indicated at 248. At zero degrees, the solenoid drive current is turned on as shown by portion 250 of solenoid drive current plot 240. Thereafter, the solenoid drive current is set at a lower current as shown by portion 252 of plot 240. Portion 252 allows fuel injection rate shaping. After rate shaping, the drive current is turned up for the main injection, as shown at portion 254 of plot 240. To eventually bring about the end of injection, the solenoid drive current is turned off, as shown by portion 256 of plot 240.

The dual spring configuration in combination with the varying solenoid drive current plot 240 facilitates rate shaping as best shown by portion 260 of valve position plot 242.

With reference to FIG. 8, a single spring embodiment of the present invention is generally at 270. Pump 270 has a pump body 272, which includes a control valve chamber 274. A control valve 276 has a valve body 278 that is disposed in control valve chamber 274. In the fully open position, which is the deactuated position for control valve 276, valve body 278 abuts a valve stop 280. An armature 282 is secured to control valve 276. Control valve 276 is actuatable by energizing a solenoid within a stator 284. Armature 282 is encircled by a stator spacer 286 located between stator 284 and pump body 272.

A single control valve spring 290 has one end abutting a control valve spring seat 292, and another end abutting a spring retainer 294. Spring seat 292 is shaped such that control valve spring 290 biases valve body 278 toward valve stop 280 over a limited portion of the total control valve stroke range. This limited portion is defined as the interval of the stroke range from the closed position to the rate shape position.

FIG. 9 depicts a graph of force versus valve lift for pump 270 (FIG. 8). A force versus lift plot is generally indicated at 300. Plot 300 has a first portion 302 at which the single control valve spring provides a first spring bias that urges the control valve toward the open position. A force step is indicated at portion 304 of plot 300. A second portion 306 of plot 300 shows the second spring bias acting on the control valve during the remaining portion of the stroke range as substantially equal to zero. That is, fluid force from the fuel is used to fully open the control valve.

Figure 10:
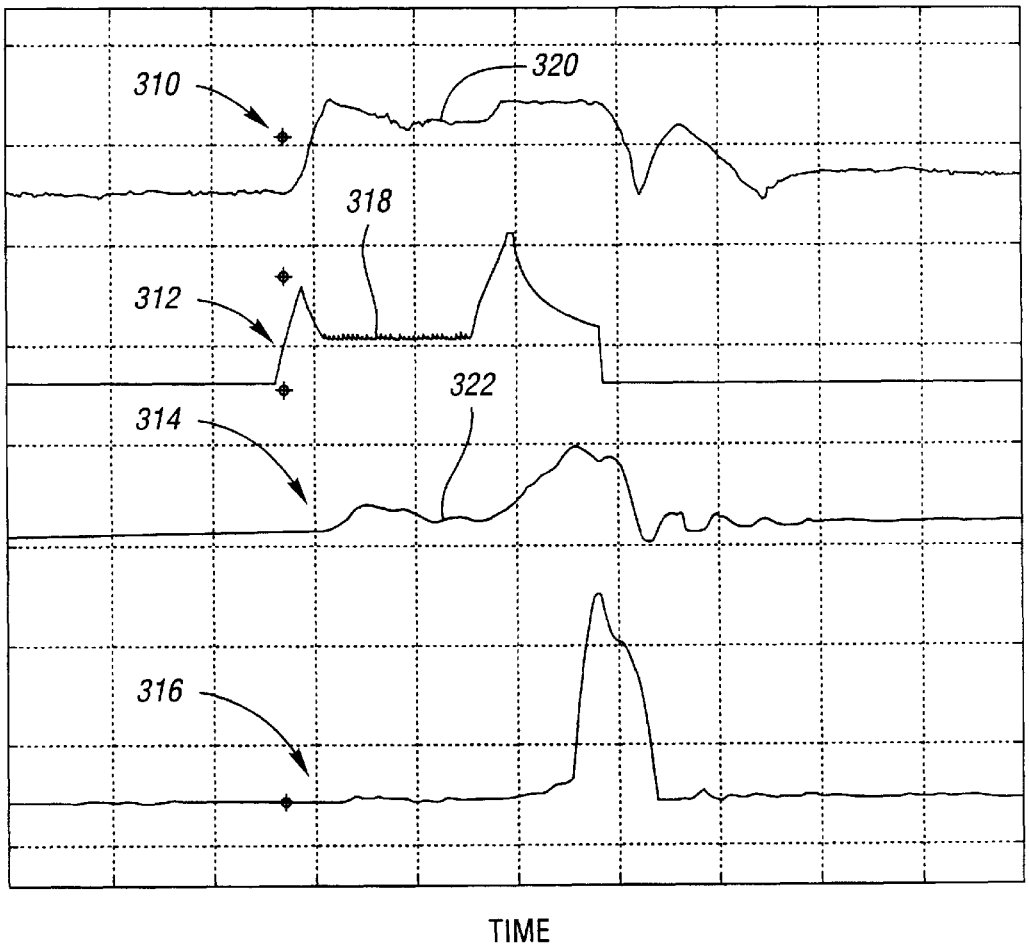
FIG. 10 is a graph depicting injection characteristics for the single spring control valve shown in FIG. 8.

With reference to FIG. 10, a graph depicts several fuel injection characteristics when using embodiments of the present invention constructed as shown in FIG. 8. A plot of control valve position is generally indicated at 310, while a plot of solenoid drive current is generally at 312. A plot of injection pressure is generally indicated at 314, while a plot of rate of injection is generally indicated at 316. It is to be appreciated that the fuel injection characteristics shown in FIG. 10 are similar to those shown in FIG. 7. As such, a careful examination of the plots by one of ordinary skill in the diesel fuel injection system art would make apparent similarities and differences between the different embodiments of the present invention.

At this time, the inventor prefers dual spring embodiments of the present invention over single spring embodiments of the present invention. More particularly, at this time, the inventor prefers dual spring embodiments of the present invention in which one spring is at the control valve, while the other spring is within the valve stop such as, for example, the embodiment shown in FIG. 4 due to manufacturing considerations. Further, one of ordinary skill in the art would appreciate that dual spring embodiments with one spring at the valve stop may be configured to have the further advantage of damping valve bounce during valve opening. Thus, it is even further preferred to appropriately provide one or more vent orifices in the stop member to accommodate fluid flow therethrough.

With continuing reference to FIG. 10, rate shaping portion 318 of solenoid drive current plot 312 corresponds to portion 320 of control valve position plot 310, at which the control valve is in the rate shape position. A portion 322 of injection pressure plot 314 shows the shaping of the injection pressure.

Figure 11:
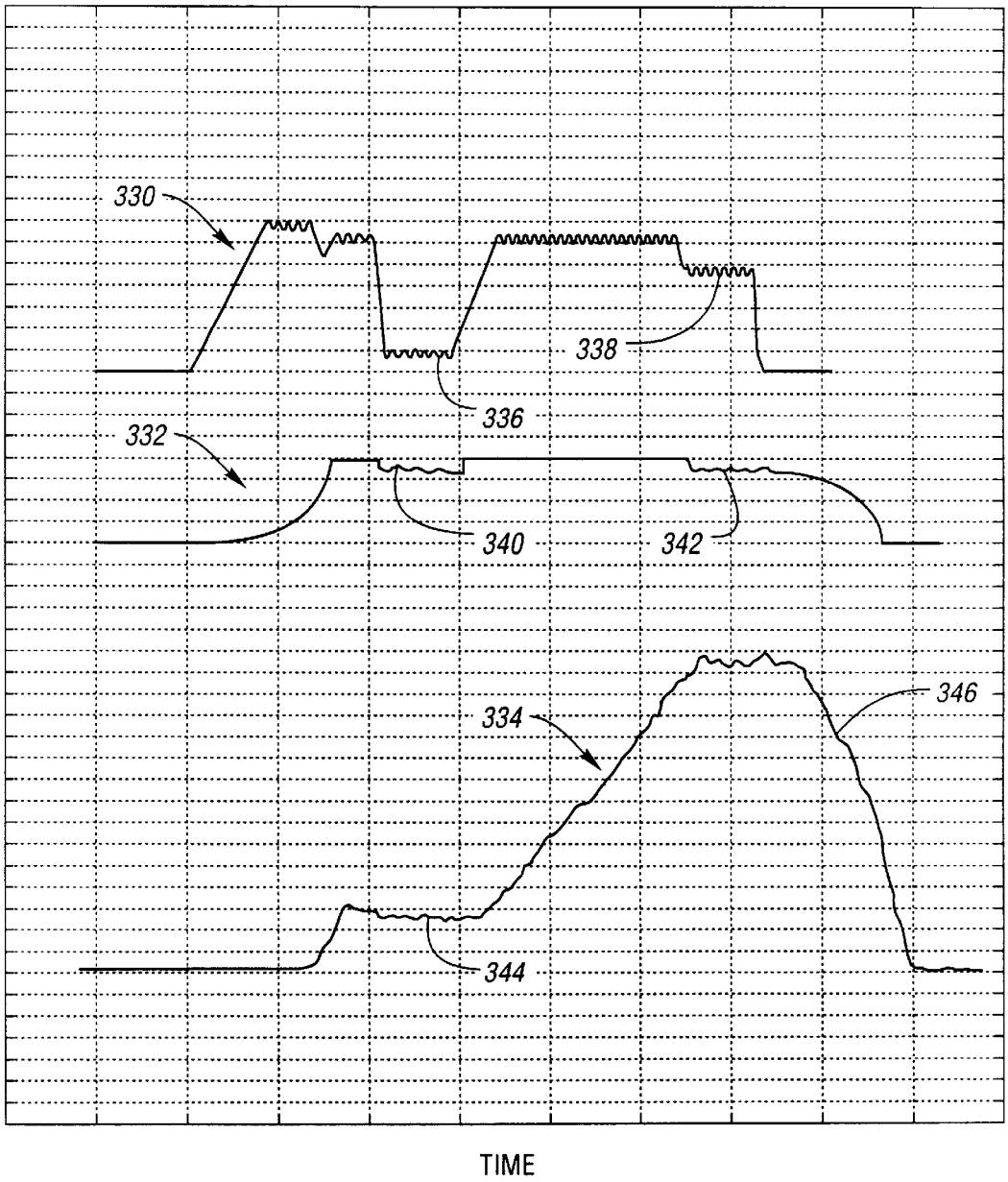
FIG. 11 is a graph depicting current controlled fuel injection in accordance with the present invention, illustrating solenoid current, solenoid valve motion, and injection pressure.

With reference to FIG. 11, a graph depicts a current controlled programmable injection rate that is achievable with embodiments of the present invention, showing several different injection characteristics versus time. A plot of solenoid drive current is generally indicated at 330, while a plot of solenoid valve motion is generally indicated at 332. A plot of injection pressure is generally indicated at 334.

It is to be appreciated that the fuel injection characteristics shown in FIG. 11 are similar to those shown in FIGS. 7 and 10. However, there are several points of interest that are specifically shown in FIG. 11. For example, injection rate regulation is achieved by portion 336 of solenoid current plot 330. Further, maximum pressure regulation is achieved by portion 338 of solenoid current plot 330. At portion 340 of valve position plot 332, the control valve is at the rate shape position which corresponds to portion 336 of solenoid drive current plot 330. Further, at portion 342 of solenoid valve position plot 332, the control valve is again held near the rate shape position, during portion 338 of solenoid drive current plot 330. Still further, portion 344 of injection pressure plot 334 shows a boot type injection. Portion 346 of injection pressure plot 334 shows noise reduction at the end of injection which is achieved with the max pressure regulation techniques described immediately above.

Of course, it is to be appreciated that although FIGS. 7, 10 and 11 show rate shaping used for a boot type injection, it is to be appreciated that embodiments of the present invention may be employed for boot injection as well as split injection, as desired for a particular application as would be understood by one of ordinary skill in the diesel fuel injection system art.

Figure 12:
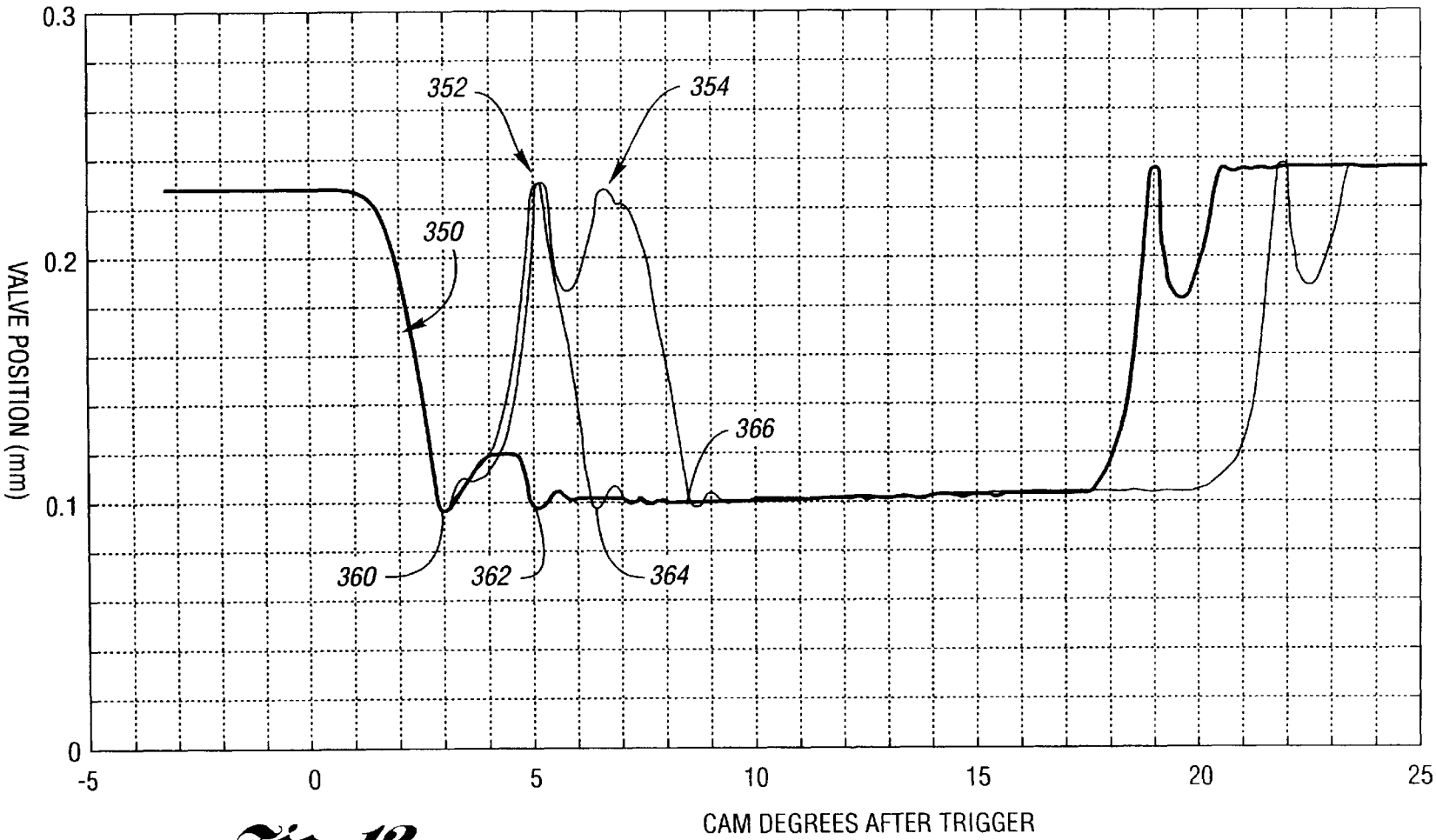
FIG. 12 is a graph depicting pilot to main injection separation with embodiments of the present invention, and also depicts first impact and first bounce type pilot to main separations for comparison to short stop separations with the present invention.

With reference to FIG. 12, a graph depicts valve position versus cam degrees after trigger for an embodiment of the present invention. The graph in FIG. 12 also depicts plots of other injection techniques to help clearly illustrate the advantages associated with embodiments of the present invention. A plot of valve position versus cam degrees after trigger for embodiments of the present invention is generally indicated at 350. Plot 350 illustrates the "short-stop" technique for controlling fuel injection. The control valve may be held at a rate shape position, that is, may be stopped short, to allow controlled pressure relief between an initial injection event and a main injection event. Of course, the initial and main injection events may form a boot type injection or may form a split injection with separate pilot and main injections.

A plot depicting valve position versus cam degrees after trigger for a first impact technique for separating initial and main injection events is generally indicated at 352. A plot depicting valve position versus cam degrees after trigger for a first bounce technique for separating initial and main injection events is generally indicated at 354.

It is to be appreciated that in accordance with the present invention, as shown on plot 350, a distance between the initial injection event which occurs at about point 360 and the main injection event which begins at about point 362 is reduced relative to the distances associated with first impact and first bounce techniques. As shown, with first impact techniques, the initial injection event occurs at about point 360 while the main injection event begins at about point 364. Further, with first bounce techniques, the initial injection event occurs at about point 360 while the beginning of the main injection event occurs at about point 366.

It is to be appreciated that the beginning of main injection at point 362 with embodiments of the present invention provides reduced separation between initial and main injection events. As would be appreciated by one of ordinary skill in the diesel fuel injection system art, having the ability to reduce this separation distance allows more sophisticated and precise control over the fuel injection process.

Figure 13:
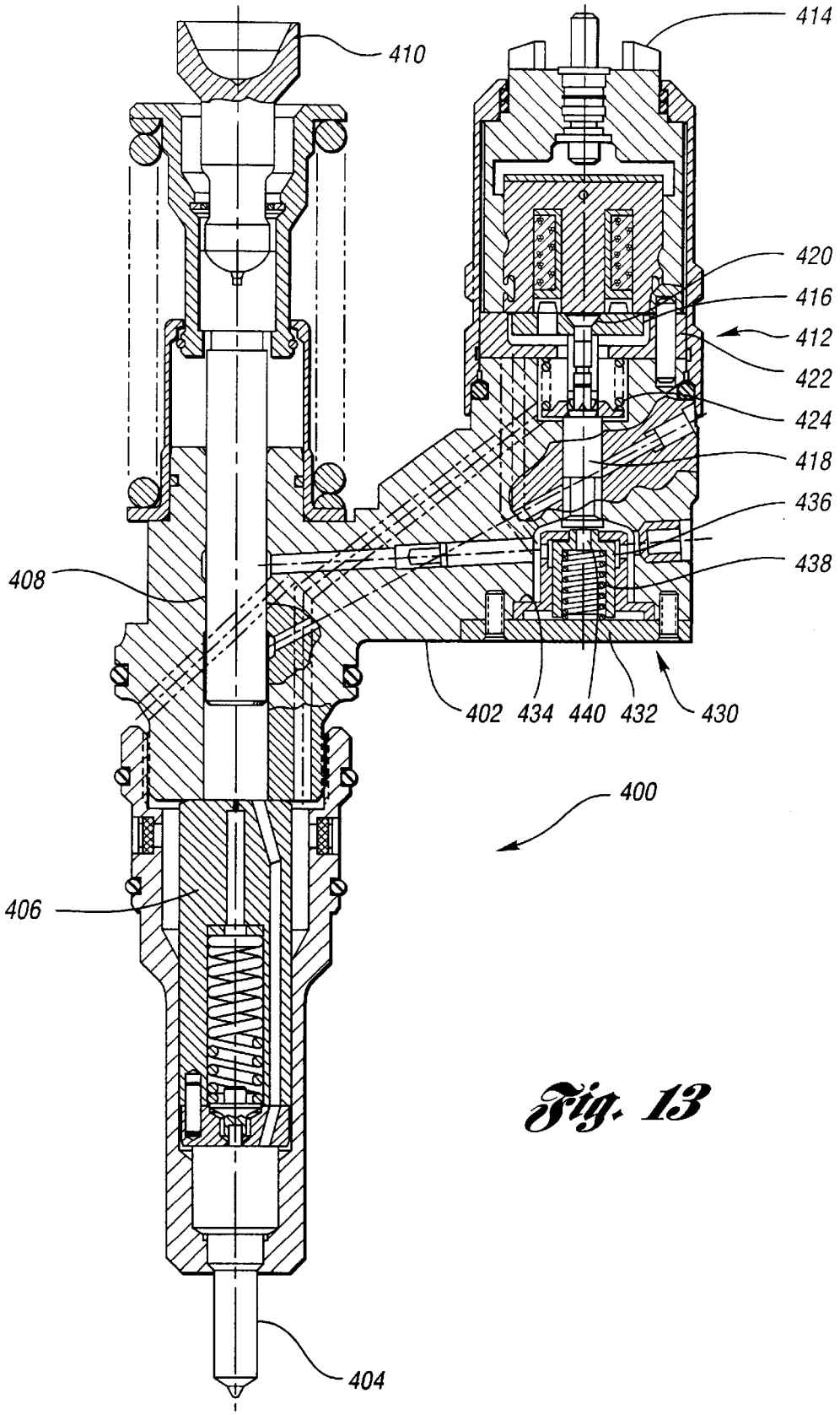
FIG. 13 is a side elevation, in section, of an injector for a fuel injection system made in accordance with the present invention.

With reference to FIG. 13, an injector 400 made in accordance with the present invention is illustrated. Injector 400 has an injector body 402 and a nozzle assembly 404. A spring cage assembly 406 is located adjacent to nozzle assembly 404. A plunger 408 is reciprocatably driven within body 402 by a push rod 410. A stator 414 includes an actuator, such a solenoid, for controlling an electronically controlled valve assembly 412. An armature 416 is secured to a control valve 418 by an armature screw 420. Armature 416 is encircled by a stator spacer 422. Control valve 418 is biased toward a deactuated position, which is the open position, by a control valve spring 424. Upon actuation, armature 416 is pulled toward stator 414 resulting in control valve 418 moving against the spring 424 into the actuated position which is the closed position.

Injector 400 operates in a known manner, as shown, for example, in U.S. Pat. No. 4,618,095, assigned to the assignee of the present invention, and hereby incorporated by reference in its entirety. As depicted, injector 400 employs a valve stop assembly 430 held in place by a stop plate 432. Valve stop assembly 430 includes a main body 434 and a stop member 436. Stop member 436 is biased by valve stop assembly spring 438. Valve stop assembly spring 438 cooperates with control valve spring 424 to produce the first and second spring forces required to establish the force step at a rate shape position for the control valve in accordance with the present invention. Of course, it is to be appreciated that while injector 400 is shown having a valve stop with a spring to achieve an embodiment of the present invention, other embodiments of the present invention, such as, for example, the dual concentric spring and single spring embodiments described previously may be used alternatively in injector 400 to achieve embodiments of the present invention. Preferably, stop member 436 has an axial hole 440 to provide fluid damping as described previously for a fuel pump control valve.

Figure 14:
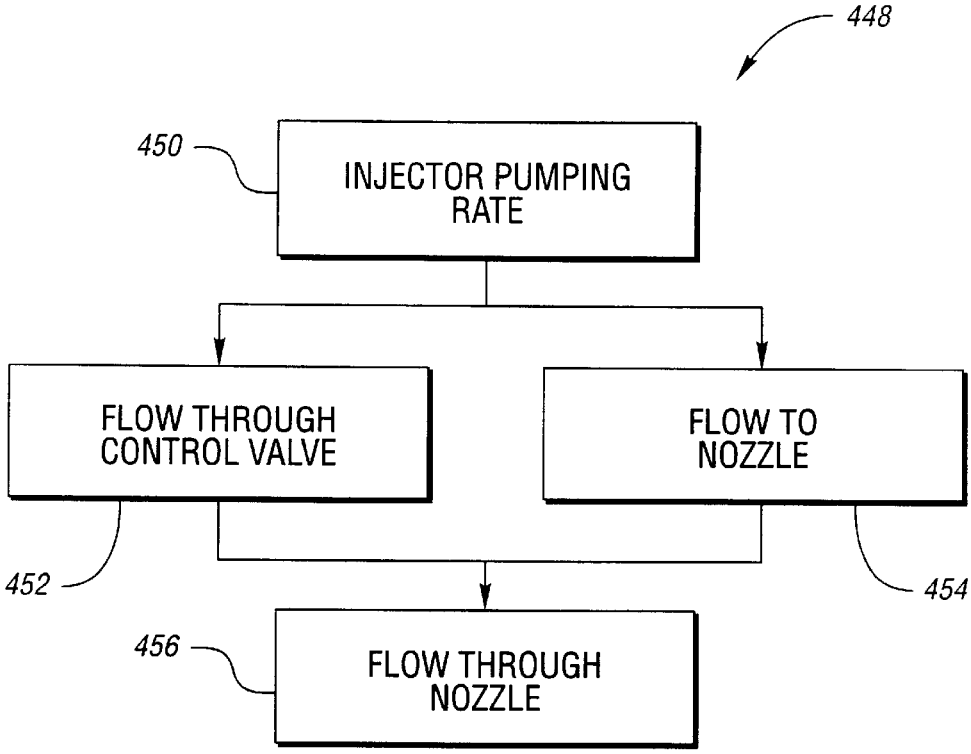
FIG. 14 is a block diagram depicting operation of a fuel injection system in accordance with the present invention.

Referring to FIG. 14, a block diagram, generally indicated at 448, depicts the fuel injection process through either a unit pump or unit injector in accordance with the present invention. That is, control valve assemblies of the present invention may be employed in pumps or injectors as described previously. At block 450, the control valve is closed as the plunger moves from the extended position to the compressed position. Rate shaping occurs at blocks 452 and 454, as fuel flows through the control valve and to the nozzle, simultaneously. At block 456, rate shaping ends as the control valve is fully closed and flow eventually goes only to the nozzle.

Figure 15:
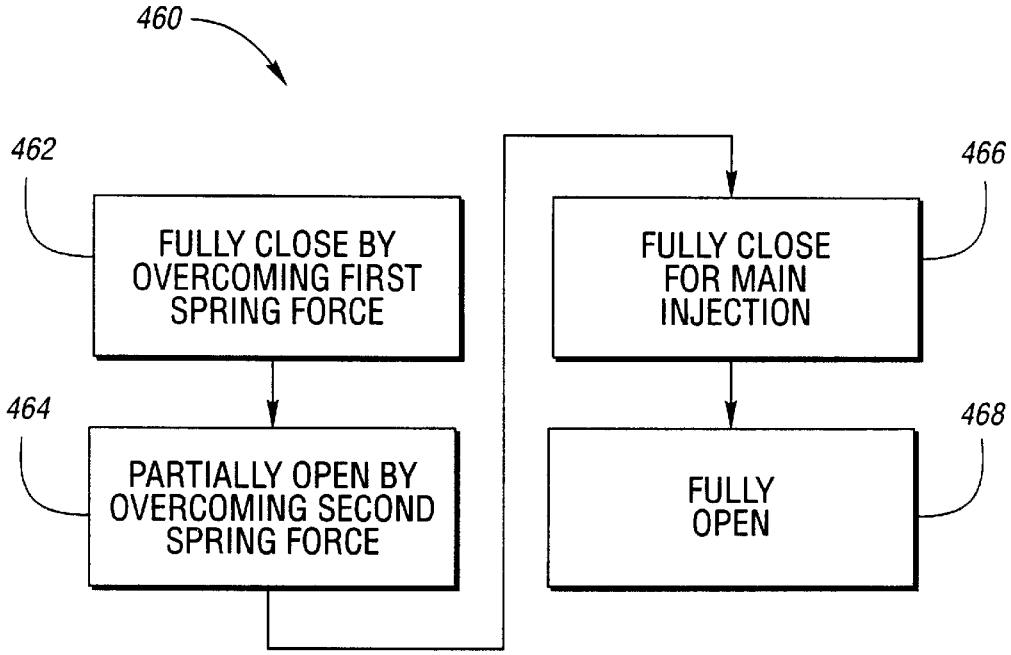
FIG. 15 is a block diagram illustrating a method of the present invention for rate shaping.

Referring to FIG. 15, a method of the present invention for operating an electromagnetic control valve having a solenoid type actuator is generally indicated at 460. At block 462, the control valve is fully closed to allow initial injection pressure to build up in the pumping chamber. Full closing of the control valve is achieved by supplying a first current to the actuator to cause the control valve to overcome a first spring force in the opening direction. The first spring force may be due to a single spring or combination of springs. At block 464, the control valve is partially opened to a rate shape position by supplying a second current to the actuator. The second current is less than the first current, and causes the control valve to overcome a second spring force that is less than the first spring force. The second spring force may be achieved by a single spring or a combination of springs such as one spring opposing another spring. Thereafter, at block 466, the control valve is fully closed to allow main injection pressure to build up in the pumping chamber. Of course, the main injection may be a separate main injection after a pilot injection, or may be the main portion of a boot injection. At block 468, the control valve is fully opened to begin the completion of the injection process.

It is to be appreciated that embodiments of the present invention may be configured in a variety of ways. In one embodiment, a single control valve spring acts to open the valve in the initial stage. After the initial "pre-stroke" the spring seat contacts a stop, allowing the valve to slide freely without spring force for the balance of the open travel. This provides a step in the opening force diagram which allows greatly solenoid force variation at the desired pre-stroke position.

In another configuration, two springs act on the control valve, with one or both unloaded at pre-selected points in the control valve travel. These spring forces may be applied in either additive form, or in an opposing manner. In either case, a step is defined in the overall force balance that provides stable operation at partially open conditions. Of course, embodiments of the present invention are not limited to one or two springs, more springs may be used if desired having unloading points that are selected based on the particular application. Further, any additional springs may provide spring force in either direction, as desired, based on the particular application.

With reference again to FIGS. 1 and 2, generally fuel flows through passageway 26 in pump body 12 toward outlet port 20 in accordance with control valve 46 being opened and closed in a fixed sequence allowing the desired fuel pressure to be developed while closed. Passageway 26 is always open to the pumping chamber, but fuel flow to the nozzle is precluded, as described, and optionally with the assist of a pressure relief valve (not shown) within the high pressure line, pursuant to conventional practice.

More specifically, the opening and closing of control valve 46 in a fixed sequence to allow the desired fuel pressure to be developed while closed will be more specifically described. Fuel is received from a fuel supply by first annulus 150 and supplied to fuel inlet 18. Fuel inlet 18 routes fuel to pumping chamber 16. The cam shaft (not shown) drives cam follower assembly 100. Plunger 30 is moved from its extended position to its compressed position, and fuel is pressurized within pumping chamber 16 when control valve 46 is held closed.

In particular, control valve 46 is held closed to build up initial pressure in pumping chamber 16. Thereafter, in accordance with the present invention, control valve 46 is moved to the rate shaping position to allow a controlled pressure relief path. After rate shaping, control valve 46 is pulled to the fully closed position to complete the fuel injection cycle.

It is to be appreciated that rate shaping techniques of the present invention may be employed for single injection operations and for split injection operations wherein a pilot injection is followed by a main injection. During testing, the inventor has found that injection pressure significantly and desirably decreases when rate shaping at the control valve is performed. During initial injection, this will allow high pumping rates without emissions penalties for improved efficiency.

While the best mode for carrying out the invention has been described in detail, those familiar with the art to which this invention relates will recognize various alternative designs and embodiments for practicing the invention as defined by the following claims.

What is claimed is:

1. A pump for a fuel injection system, the pump comprising:

a pump body having a pumping chamber, a fuel inlet for supplying fuel to the pumping chamber, an outlet port, and a control valve chamber between the pumping chamber and the outlet port;

a plunger disposed in the pumping chamber;

an actuable control valve disposed in the control valve chamber for controlling fuel, the control valve being moveable over a stroke range between an open position in which full pressure relief is provided to the pumping chamber and a closed position in which pressure relief to the pumping chamber is blocked, the stroke range including a rate shape position between the open position and the closed position in which partial pressure relief is provided to the pumping chamber;

a valve stop adjacent to the control valve chamber;

a control valve spring arrangement biasing the control valve toward the open position;

an armature at the control valve; and a stator near the armature and including a variable current actuator operable to urge the control valve toward the closed position against the bias of the control valve spring arrangement, wherein the control valve spring arrangement is configured to provide a first spring force when the control valve is between the closed position and the rate shape position, and to provide a second spring force that is less than the first spring force when the control valve is between the rate shape position and the open position, and wherein a stroke portion from the closed position to the rate shape position is sufficiently small such that the partial pressure relief provided in the rate shape position is substantially less than the full pressure relief of the open position to cause an injection event that begins while the control valve is in the closed position to continue when the valve is held in the rate shape position with varied actuator current, providing controlled injection rate shaping when the control valve is at the rate shape position.

2. The pump of claim 1 wherein the stroke portion from the closed position to the rate shape position is at most about 0.03 millimeters.

3. The pump of claim 1 wherein the stroke range is at least about 0.1 millimeters.

4. The pump of claim 1 wherein the control valve spring arrangement comprises:

a primary spring biasing the control valve toward the open position over a limited portion of the stroke range between the closed position and the rate shape position; and a secondary spring biasing the control valve toward the open position throughout the stroke range, the secondary spring cooperating with the primary spring to produce the first spring force, and the secondary spring acting unassisted to produce the second spring force.

5. The pump of claim 1 wherein the control valve spring arrangement comprises:

a primary spring biasing the control valve toward the open position throughout the stroke range; and a secondary spring biasing the control valve toward the closed position over a limited portion of the stroke range between the rate shape position and the open position, wherein the primary spring acts unassisted to produce the first spring force, and the primary spring opposes with the secondary spring to produce the second spring force.

6. The pump of claim 5 wherein the valve stop comprises:

a main body; and a stop member axially moveable within the main body, wherein the secondary spring is located within the main body and biases the stop member toward the control valve such that the control valve contacts the stop member when the control valve is between the rate shape position and the open position.

7. The pump of claim 6 wherein the stop member has an abutment surface for contacting the control valve, and wherein a vent orifice extends from the abutment surface through the stop member to allow fluid flow therethrough.

8. The pump of claim 1 wherein the spring arrangement comprises:

a single spring biasing the control valve toward the open position over a limited portion of the stroke range between the closed position and the rate shape position such that the single spring produces the first spring force, and such that the second spring force is substantially equal to zero.

9. The pump of claim 1 wherein the control valve is of the outwardly opening type in which the control valve contacts the valve stop when the control valve is in the open position.

10. A fuel injector comprising:

an injector body having a pumping chamber and a control valve chamber;

a plunger disposed in the pumping chamber;

an actuable control valve disposed in the control valve chamber for controlling fuel, the control valve being moveable over a stroke range between an open position in which full pressure relief is provided to the pumping chamber and a closed position in which pressure relief to the pumping chamber is blocked, the stroke range including a rate shape position between the open position and the closed position in which partial pressure relief is provided to the pumping chamber;

a valve stop adjacent to the control valve chamber;

a control valve spring arrangement biasing the control valve toward the open position;

an armature at the control valve; and a stator near the armature and including a variable current actuator operable to urge the control valve toward the closed position against the bias of the control valve spring arrangement, wherein the control valve spring arrangement is configured to provide a first spring force when the control valve is between the closed position and the rate shape position, and to provide a second spring force that is less than the first spring force when the control valve is between the rate shape position and the open position, and wherein a stroke portion from the closed position to the rate shape position is sufficiently small such that the partial pressure relief provided in the rate shape position is substantially less than the full pressure relief of the open position to cause an injection event that begins while the control valve is in the closed position to continue when the valve is held in the rate shape position with varied actuator current, providing controlled injection rate shaping when the control valve is at the rate shape position.

11. The injector of claim 10 wherein the stroke portion from the closed position to the rate shape position is at most about 0.03 millimeters.

12. The injector of claim 10 wherein the stroke range is at least about 0.1 millimeters.

13. The injector of claim 10 wherein the control valve spring arrangement comprises:

a primary spring biasing the control valve toward the open position over a limited portion of the stroke range between the closed position and the rate shape position; and a secondary spring biasing the control valve toward the open position throughout the stroke range, the secondary spring cooperating with the primary spring to produce the first spring force, and the secondary spring acting unassisted to produce the second spring force.

14. The injector of claim 10 wherein the control valve spring arrangement comprises:

a primary spring biasing the control valve toward the open position throughout the stroke range; and a secondary spring biasing the control valve toward the closed position over a limited portion of the stroke range between the rate shape position and the open position, wherein the primary spring acts unassisted to produce the first spring force, and the primary spring opposes the secondary spring to produce the second spring force.

15. The injector of claim 14 wherein the valve stop comprises:

a main body; and a stop member axially moveable within the main body, wherein the secondary spring is located within the main body and biases the stop member toward the control valve such that the control valve contacts the stop member when the control valve is between the rate shape position and the open position.

16. The injector of claim 15 wherein the stop member has an abutment surface for contacting the control valve, and wherein a vent orifice extends from the abutment surface through the stop member to allow fluid flow therethrough.

17. The injector of claim 10 wherein the spring arrangement comprises:

a single spring biasing the control valve toward the open position over a limited portion of the stroke range between the closed position and the rate shape position such that the single spring produces the first spring force, and such that the second spring force is substantially equal to zero.

18. The injector of claim 10 wherein the control valve is of the outwardly opening type in which the control valve contacts the valve stop when the control valve is in the open position.

19. A method for operating an electromagnetic control valve having a variable current solenoid type actuator for closing the control valve, the control valve being located between a pumping chamber and an outlet in a fuel injection system, the method comprising:

fully closing the control valve to allow initial injection pressure to build up in the pumping chamber by supplying a first current to the actuator to cause the control valve to overcome a first spring force in the opening direction;

partially opening the control valve to a rate shape position by supplying a second current to the actuator that is less than the first current to cause the control valve to overcome a second spring force in the opening direction that is less than the first spring force in the opening direction, a stroke portion from the closed position to the rate shape position being sufficiently small such that a partial pressure relief provided in the rate shape position is substantially less than a full pressure relief of an open position to cause an injection event that begins while the control valve is in the closed position to continue when the valve is held in the rate shape position, providing controlled injection rate;

thereafter, fully closing the control valve to allow main injection pressure to build up in the pumping chamber; and fully opening the control valve.

20. A pumping device for a fuel injection system, the device comprising:

a pump body having a pumping chamber that receives fuel, a high pressure outlet, and a control valve chamber separating the pumping chamber from the high pressure outlet;

a control valve assembly disposed in the control valve chamber, the assembly including a control valve movable over a stroke range between an open position in which full pressure relief is provided to the pumping chamber, a closed position in which pressure relief to the pumping chamber is blocked such that full pressure builds at the high pressure outlet, and a rate shape position in which partial pressure relief is provided to the pumping chamber and limited pressure builds at the high pressure outlet, the control valve assembly further including a first spring and a second spring, the first and second springs and the control valve being arranged such that a first opening force biases the control valve toward the open position when the control valve is between the closed position and the rate shape position, and such that a second opening spring force that is less than the first opening spring force biases the control valve toward the open position when the control valve is between the rate shape position and the open position to create a step in the spring force at the rate shape position; and a variable current solenoid assembly operative to pull the control valve toward the closed position against the bias of the first and second springs, the solenoid assembly operating at a first current to close the control valve, and operating at a second current to hold the control valve at the rate shape position with the step in the spring force, the second current being less than the first current.

21. The device of claim 20 wherein the device is a unit pump and wherein the high pressure outlet is a pump outlet port that connects to a fuel injector through a high pressure line.

22. The device of claim 20 wherein the device is a unit injector and wherein the device further comprises:

a nozzle assembly including a nozzle chamber and a needle, wherein the high pressure outlet routes fuel to the nozzle chamber.

23. The device of claim 20 wherein a stroke portion from the closed position to the rate shape position is at most about 0.03 millimeters.

24. The device of claim 20 wherein the stroke range is at least about 0.1 millimeters.

* * * * *

UNITED STATES PATENT AND TRADEMARK OFFICE

CERTIFICATE OF CORRECTION

PATENT NO. : 6,276,610 B1
DATED : August 21, 2001
INVENTOR(S) : Spoolstra

It is certified that error appears in the above-identified patent and that said Letters Patent is hereby corrected as shown below:

Title page,
Item [*] Notice, "Subject to any disclaimer, the term of this patent is extended or adjusted under 35 USC 154(b) by (0) days", delete the phrase "by 0 days" and insert -- by 240 days --

Signed and Sealed this

Fourteenth Day of October, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,276,610 B1
DATED : August 21, 2001
INVENTOR(S) : Seem et al.

It is certified that error appears in the above-identified patent and that said Letters Patent is hereby corrected as shown below:

Title page,
Item [*] Notice, delete the phrase “by 0 days” and insert -- by 240 days --

Signed and Sealed this

Fifth Day of October, 2004

JON W. DUDAS
*Director of the United States Patent and Trademark Office*